US005321861A

United States Patent [19]

Dancey et al.

[11] Patent Number: 5,321,861

[45] Date of Patent: Jun. 21, 1994

[54] PROTECTIVE COVER

[76] Inventors: Elizabeth Dancey, Ernest J. Dancey, both of 39 Spring Crescent, Portswood, Southampton S02 1FZ, United Kingdom

[21] Appl. No.: 955,715

[22] PCT Filed: Jun. 6, 1991

[86] PCT No.: PCT/GB91/00907

§ 371 Date: Dec. 18, 1992

§ 102(e) Date: Dec. 18, 1992

[87] PCT Pub. No.: WO91/19443

PCT Pub. Date: Dec. 26, 1991

[30] Foreign Application Priority Data

Jun. 20, 1990 [GB] United Kingdom ..... 9013799.3

[51] Int. Cl.[5] ..... A47C 27/00; A47G 9/00

[52] U.S. Cl. ..... 5/482; 5/470; 5/490; 5/501

[58] Field of Search ..... 5/482, 490, 470, 448, 5/500, 501; 428/264, 265, 245, 246

[56] References Cited

U.S. PATENT DOCUMENTS

| | | | |
|---|---|---|---|
| 2,400,731 | 5/1946 | Armstrong | 5/500 |
| 4,429,000 | 1/1984 | Naka et al. | 427/246 |
| 4,508,775 | 4/1985 | Adiletta | 5/483 |
| 4,535,008 | 8/1985 | Naka et al. | 428/265 |
| 4,695,484 | 9/1987 | Tanaka et al. | 427/245 |
| 4,803,116 | 2/1989 | Amano et al. | 427/246 |
| 5,050,256 | 9/1991 | Woodcock | 5/482 |

FOREIGN PATENT DOCUMENTS

| | | |
|---|---|---|
| 0225060 | 6/1987 | European Pat. Off. . |
| 0323116 | 7/1989 | European Pat. Off. . |
| 2737756 | 3/1979 | Fed. Rep. of Germany . |
| 3440963 | 5/1986 | Fed. Rep. of Germany . |
| 1596158 | 8/1981 | United Kingdom . |
| 2213053 | 8/1989 | United Kingdom . |

OTHER PUBLICATIONS

"Allergy Control Products"-Brochure from ACPCO 89 Danbury Rd., P.O. Box 793 Ridgefield, Conn. 06877-1984.

*Primary Examiner*—Alexander Grosz

*Attorney, Agent, or Firm*—Shoemaker and Mattare Ltd.

[57] ABSTRACT

A protective cover for upholstered or padded articles such as bedding is made from a microporous ultrafilter material having a pore size of less than 0.0005 mm, to suppress passage of fecal particles produced by house dust mites. To prevent particles from bypassing the ultrafilter material, the seams of the cover are welded, and its opening is sealed by a resealable fastener, such as a zip-fastener, covered with an adhesive tape.

10 Claims, 1 Drawing Sheet

PROTECTIVE COVER

This invention relates to a protective cover more particularly but not exclusively for enclosing an upholstered or padded article.

Many people suffer from allergies caused by airborne fine particulate matter such as pollen, dust, house dust mite, flour mite in bakeries, feathers, bird faeces, molds and inorganic dust. It has been found that asthma sufferers are allergic to house dust and the house dust mite that lives in the dust.

The house dust mite, Dermatophagoides pteronyssimus is a member of the spider family, it measures 0.3 mm across and is indistinguishable from a speck of dust. It accounts for 74% of the mite population in samples taken from London homes, and is concentrated, in highest numbers in and around beds and bedding.

It has been found that although the mite per se, due to its relatively large size, cannot cause an allergic reaction, part of the mite faecal pellet, measuring 20 microns (20/1000 mm) in diameter is the cause of the allergic reaction. This allergic portion has been named Der p1, is small, becomes airborne and is easily inhaled and deposited on the inner lining of the respiratory tract.

Present treatments of the above mentioned allergies is by means of drugs to suppress the allergic response or to protect the target organ.

Various prior art proposals have been made to provide a cover as a barrier material for allergic fragments.

British Patent No. 1596158 relates to a mattress cover of free-water proof but is chemically physicochemically porous to permit the transmission of water vapour from one side of the cover to the other. However it is only intended to partially cover the mattress and is provided with means to hold the cover to the mattress.

Another prior art UK patent application No. 2213053A uses a material having a pore size of less than 10 microns to act as a mite barrier However, recent research has shown that the allergenic fragment Der P1 can pass easily through fabrics having a pore size down to a single micron (one thousandth of a millimeter). Other microporous fabrics such as those mentioned in UK application No. 2213053A are available but these consist of coated fabrics or laminated fabrics which use various chemicals in their production and which could provoke an allergic reaction in certain individuals. It is therfore essential to use an inert material which has no known chemical reaction.

An aim of the present invention is to minimise the discomfort and treatment of the above mentioned allergies by providing a preventative protective cover acting as a barrier to isolate the cause of the allergy.

According to the present invention there is provided a protective cover for upholstered and padded articles comprising a removable cover shaped to fit the article, the cover being made of air and moisture permeable microporous ultrafilter material seamed at the joins, wherein the micropores are less than half a thousandth of a millimeter (0.0005 mm) in outside dimension and the seams are welded.

Conveniently, the protective cover is made by securing the seams by high-frequency welding in such a way that the barrier protection is not lost.

Preferably, the protective cover is made of a washable material.

In a preferred construction the protective cover has an opening for the article which is closed by a zipfastener which is covered and sealed by a single-sided adhesive tape.

Embodiments of the present invention will now described, by way of example, with reference to the accompanying drawings in which.

Allergy to house dust is common as will be apparent when, for example, clearing out old cupboards causes one to sneeze. However, some people react to much smaller concentration of house dust than that found in old cupboards. House dust consists of dead skin shed by people and animals as well as particles from, one's clothes, food and furniture, these particles are shed, become airborne and settle with time.

Within the house dust lives a dust mite, which is of the spider family and the most common species in England and Europe is Dermatophagoides pteronyssimus while in the USA it is the related D.farinae, the flour mite.

The house dust mite feeds on human skin scales, it needs to obtain its moisture from the air, thus it is found mostly in warm moist areas, around bedding and upholstered furniture. The ideal habitat for the house dust mite is a temperature of about 25° C. and a humidity of 80% making the Northern European climate the perfect breeding ground for the house dust mite. They can number 3,000 per gram of house dust. As stated earlier, the main allergenic fragment is part of the house dust mite faecal pellet, dried and airborne, Der p1.

The major symptoms referrable to allergy to the house dust mite are as follows:

asthma—80% of asthmatic children exhibit an allergy to house dust and house dust mite.

rhinitis (runny/blocked nose, sneezing) itchy runny eyes; sneezing; hayfever (it worstens existing hayfever) and, eczema.

The treatment of these illnesses at the moment relies on the folowing principals;

1. Pharmacological suppression of the immune response by;
   a) systemic or local steroids;
   b) antihistamines;
   c) mast cell stabilisers
2. Pharmacological protection of the target organ by:
   a) beta 2 stimulants e.g., salbutamol;
   b) auticholinergics, e.g., ipatroplum
   c) xanthine derivatives e.g., aminophylline.

However, despite the advance in drug therapy, many sufferers do not lead a symptom free life and still rely heavily on avoidance to help their treatment.

The current avoidance procedure is to remove as much as possible the source of house dust and to render the environment less-habitable for the house dust mite, for example, by scrupulous cleaning and careful choice of materials.

The present invention seeks to eliminate completely the hitherto remaining important source of the house dust and house dust mite by totally enclosing the habitat of the house dust mite, thus forming a complete barrier preventing it and its products from becoming airborne and reaching the human respiratory tract.

Figure 1:
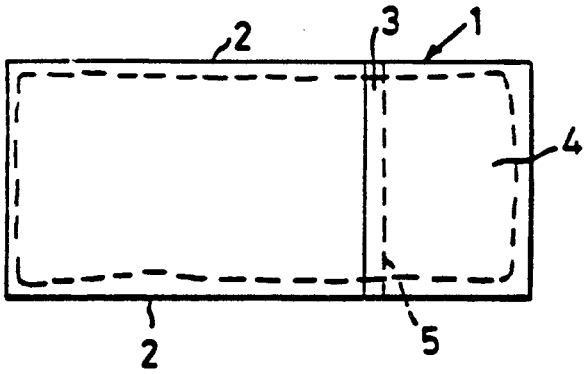
FIG. 1 is a diagrammatic view of a protective cover for enclosing a pillow/cushion.

The protective cover illustrated in FIG. 1 is formed as a pillow/cushion case 1 of air and moisture permeable microperforated ultrafilter material. The pillow case is closed along its side edges 2 by sealing in such a way that the barrier effect is not compromised, the opening 3 of the pillow case for inserting the pillow is formed by a flap 4 which is closed by a zip-fastener and sealed to the body of the pillow case by, for example, a single-sided adhesive tape 5.

Figure 2:
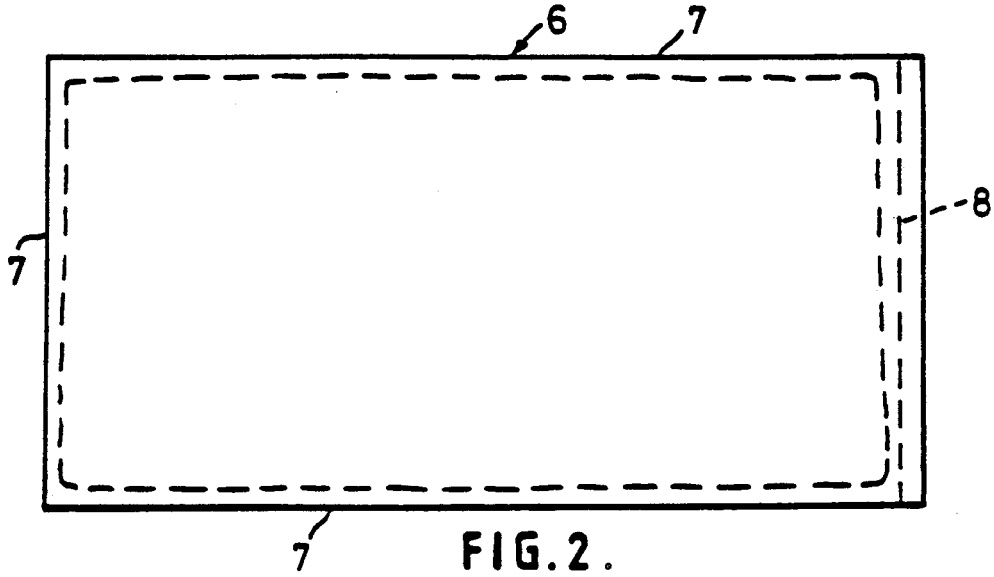
FIG. 2 is a similar view to FIG. 1 of a protective cover for enclosing a duvet.

In the second embodiment of the protective cover shown in FIG. 2 for a duvet, the cover 6 is made by sealing two sheets of air and moisture permeable microperforated ultrafilter material along three sides 7 in such a way as not to compromise the barrier, the fourth side being sealed, when the duvet is placed in the cover, by a strip of single-sided adhesive tape 8.

Figure 3:
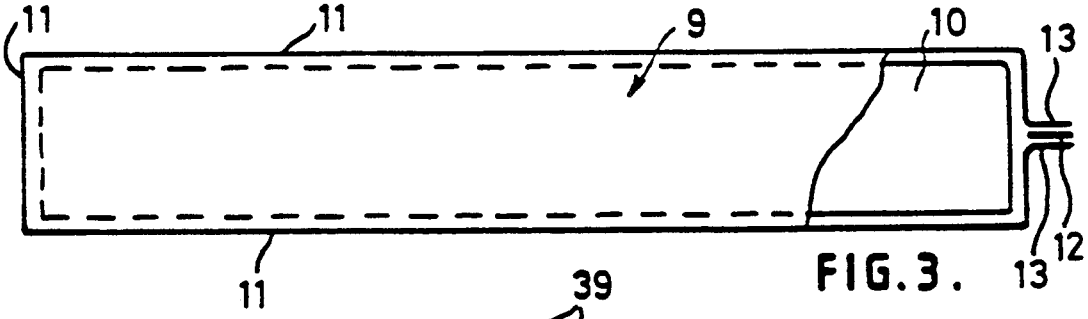
FIG. 3 is a diagrammatic view of a protective cover for enclosing a mattress.

In a third embodiment of the invention shown in FIG. 3 the cover 9 encloses a mattress 10. In this construction the cover is made from sheets of air and moisture permeable microperforated ultrafilter material by sealing the sheets along their edges 11 in such a way, for example by glueing, heat sealing or high frequency welding so as not to compromise the barrier effect to form a rectangular cover. One end of the cover 9 has an opening for inserting the mattress which opening is closed by a zip-fastener and sealed by a strip of single-sided adhesive tape 12 placed between the edges 13 of the opening.

In each embodiment the microperforations of the material from which the protective cover is made, must be less than half a thousandth of a millimeter (0.0005 mm) in width. This prevents the microscopic organisms and their dried faecal pellets from escaping into the room and vicinity of the user and causing an allergic reaction. These specialised materials are made from microperforated high-density plastic fibres which permit the material to breath and are washable, tear and shrink resistant.

With existing protective covering, for example rubber or plastic sheets for beds, these have the disadvantage that although they would trap the microscopic particles they do not allow transpiration of moisture which causes great discomfort to the user as the human body of an adult produces approximately 500 ml of persperation per night. The plastic or rubber sheets are also bulky and relatively expensive.

Figure 4:
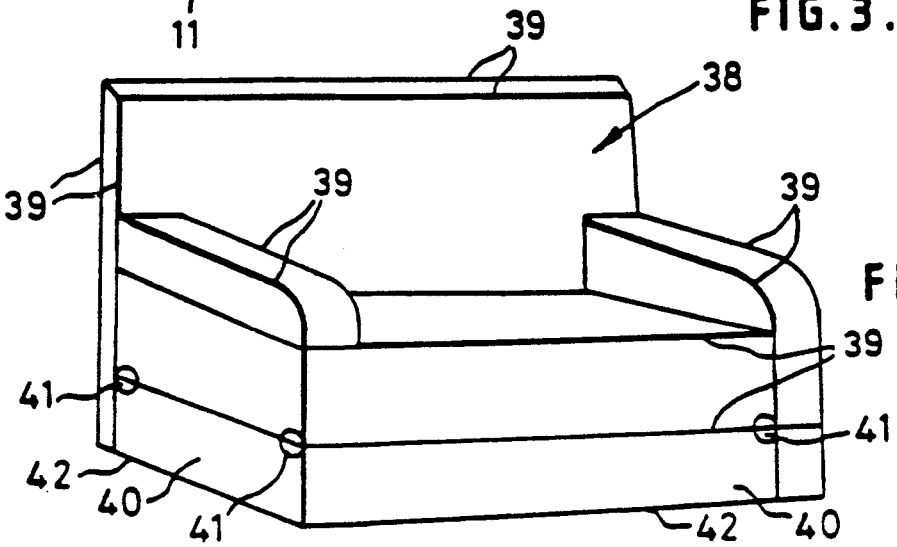
FIG. 4 is a perspective view of an easy chair fitted with a protective cover according to the invention.

It will be apparent that the protective cover can be shaped to fit any upholstered piece of furniture such as an easy chair or settee where house mite may harbour. FIG. 4 illustrates a perspective view of a protective cover for an easy chair. The cover is made of an air and moisture permeable microperforated ultrafilter material 38 which is sealed along seams 39 to fit the upper surface of the easy chair. The lower margins 40 of the protective cover have holes 41 at their corners to allow the easy chair casters (not shown) to protrude. The margins 40 are folded under the chair and sealed along their edges 42, to conform to the floor line of the easy chair.

The protective covering of the present invention is made of a fine light pliable material that does not smell or make a noise when crinkled, is microporous, the size of the micropores being an average of half a thousandth of a millimeter (0.0005 mm) in outside dimension and follow a convoluted path. The cover weighs less than 40 grams per square meter. It can be treated to be rendered antistatic, and is of durable quality that will stand up to the rigours of the most demanding user.

We claim:

1. A protective cover for upholstered and padded articles comprising a removable cover shaped to fit the article, the cover being made of an air and moisture permeable microporous ultrafilter material having welded seams, wherein the micropores are less than half a thousandth of a millimeter (0.0005 mm) in outside dimension, and wherein the cover has an opening into which an article can be inserted, a resealable fastener for closing the opening, and a sealing tape covering the fastener.

2. A protective cover as claimed in claim 1, made by securing the seams by high-frequency welding.

3. A protective cover as claimed in claim 1, made of a washable material.

4. A protective cover as claimed in claim 1, made in the shape of a pillow case.

5. A protective cover as claimed in claim 1, made in the shape of a duvet cover.

6. A protective cover as claimed in claim 1, made in the shape of a mattress cover.

7. A protective cover as claimed in claim 1, made in the shape of a cushion cover.

8. A protective cover as claimed in claim 1, made in the shape of an easy chair cover.

9. A protective cover as claimed in claim 1, wherein the fastener is a zip-fastener and the tape is a single-sided adhesive tape.

10. A protective cover as claimed in claim 1, weighing less than 40 grams per square meter.

* * * * *